United States Patent [19]

Tabei et al.

[11] 4,356,246

[45] Oct. 26, 1982

[54] METHOD OF MAKING α-SILICON POWDER, AND ELECTROPHOTOGRAPHIC MATERIALS INCORPORATING SAID POWDER

[75] Inventors: Masatoshi Tabei; Keiji Takeda; Kazuhiro Kawaziri; Akio Higashi, all of Asaka, Japan

[73] Assignee: Fuji Photo Film Co., Ltd., Kanagawa, Japan

[21] Appl. No.: 159,566

[22] Filed: Jun. 16, 1980

[30] Foreign Application Priority Data

Jun. 15, 1979 [JP] Japan ..... 54-74553

[51] Int. Cl.[3] ..... G03G 5/082

[52] U.S. Cl. ..... 430/136; 430/58; 430/84; 430/95; 430/96; 204/192 P; 252/501.1; 427/39; 427/74

[58] Field of Search ..... 430/58, 84, 95, 96, 430/127, 136; 204/192 P; 252/501.1; 427/39

[56] References Cited

U.S. PATENT DOCUMENTS

| | | | |
|---|---|---|---|
| 3,121,006 | 2/1964 | Middleton et al. | 430/84 X |
| 3,694,201 | 9/1972 | Behringer | 430/136 |
| 3,870,516 | 3/1975 | Smith et al. | 430/96 X |
| 3,894,868 | 7/1975 | Regensburger | 430/96 X |
| 3,911,091 | 10/1975 | Karam et al. | 430/84 X |
| 3,953,207 | 4/1976 | Horgan | 430/58 |
| 4,225,222 | 9/1980 | Kempter | 430/57 X |
| 4,265,991 | 5/1981 | Hirai et al. | 204/192 P X |

OTHER PUBLICATIONS

Moustakas et al., "Preparation of Highly Photoconductive Amorphous Silicon by rf Sputtering", Solid State Comm., vol. 23, No. 3, pp. 155–158 (1977).

*Primary Examiner*—Roland E. Martin, Jr.
*Attorney, Agent, or Firm*—Sughrue, Mion, Zinn, Macpeak & Seas

[57] ABSTRACT

A noncrystalline silicon powder having excellent photoconductivity is described, comprising silicon and hydrogen, exhibiting an infrared absorption spectrum characterized by absorption peaks centered at about 2000 $cm^{-1}$ and 630 $cm^{-1}$, wherein the height of the absorbance peak at 2000 $cm^{-1}$ is at least one-tenth the height of the peak centered at 630 $cm^{-1}$, and exhibiting a spin density of not more than $10^{18}$ $cm^{-3}$ determined by electron spin resonance spectroscopy; the noncrystalline silicon powder is used as highly efficient photoconductor in photoconductive compositions utilized for the production of electrophotographic photoreceptors.

4 Claims, 3 Drawing Figures

METHOD OF MAKING α-SILICON POWDER, AND ELECTROPHOTOGRAPHIC MATERIALS INCORPORATING SAID POWDER

BACKGROUND OF THE INVENTION

1. Field of the Invention

The present invention relates to a noncrystalline silicon powder, and to photoconductive compositions and electrophotographic photoreceptors using such a silicon powder.

2. Description of the Prior Art

Electrophotography is one of the methods commonly used for the formation of permanent images, and employs the following basic steps. First, the surface of an electrophotographic photoreceptor, which comprises of a photoconductive layer provided on a conductive support, is uniformly charged in the dark. Then, the photoreceptor exposed to an imagewise pattern of active rays, generally electromagnetic waves, thereby discharging in the exposed areas thereof the charge created by the charging step, resulting in the formation of an electrostatic latent image. Next, the resulting electrostatic latent image is developed with a toner, and the toner image is optionally transferred on an image receiving layer. Finally, the toner image is fixed.

Known photoconductive substances employed for the photoconductive layers of electrophotographic photoreceptors include inorganic compounds, such as amorphous selenium, selenium alloys, semiconductors of metal compounds (e.g., oxides of cadmium, zinc and like metals, sulfides of such metals, and selenides of such metals), etc., and organic compounds, such as organic polymers like polyvinyl carbazole, dyes, pigments, and so forth.

Crystalline or amorphous silicon has been used as a photoelectric transformation element (e.g., a photoelectromotive element, a photoconductive element and so on). However, electrophotographic photoreceptors prepared by utilizing silicon in such states have not been known in the art.

A thin solid film of noncrystalline silicon (in which hydrogen atoms are not contained) prepared by using a vacuum evaporation or a sputtering technique has low resistivity ($\sim 10^3$ Ωcm), scarcely has any degree of photoconductivity, and does not fluoresce light of any wavelengths. In addition, the spin density of the noncrystalline silicon thin solid film, which can be determined from an ESR (electron spin resonance) measurement, is known to be very high ($10^{19-20}$ $cm^{-3}$); from this, the existence of a great number of defects can be presumed to exist. In contrast to the above-described thin solid silicon film, thin solid films of hydrogen-containing noncrystalline silicon have high resistivity ($10^{9-10}$ Ωcm), great photoconductivity, and low spin density. It can, therefore, be presumed that hydrogen plays an important role in the reduction of defects. Earlier studies on noncrystalline silicon have been undertaken to investigate in detail the properties thereof in the state of a thin solid film, as reported in the known literature, for example, R. C. Chittick, J. H. Alexander and H. F. Sterling, *J. Electrochem. Soc.* 116 (1969) 77 W. E. Spear and P. G. LeComber, *J. Noncryst. Solids* 8-10 (1972) 727 W. E. Spear and P. G. LeComber, *Solid State Comm* 17 (1975) 1193 D. E. Carlson, C. R. Wronski, J. I. Pankove, P. J. Zanzucci and D. L. Staebler, *RCA Rev.* 38 (1977) 211. On the other hand, investigations on noncrystalline silicon in the powder state have scarcely been known. That is because it has been supposed that contamination with noncrystalline silicon fine powder should be prevented in the formation of the solid thin film of silicon, because of adverse influences upon the quality of the film formed. Consequently, there exists a historical background suggesting that the preparation of thin solid films of good quality should be undertaken from the technical standpoint of finding conditions under which any sorts of powder is not produced, as described, for instance, in A. L. Armirotto, *Solid State Technology,* Volume 11, page 43 (1968).

As for noncrystalline silicon powder, a brief description thereof is found in Brodspy, *Thin Solid Film,* Volume 40, L23 to L25 (1977), Nita and Shimakawa, *Kotai Butsuri* (*Solid Physics*), Volume 12, page 165 (1977), and Spanier and McDiamid, *Inorganic Chemistry,* Volume 1, pages 432 to 433 (1962). Brodsky describes only the fact in the literature that the glow discharge decomposition of silane under the condition of elevated pressure (0.8 Torr) leads to polymerization of silane, and polysilane "snow" (that is, small particles) separates out as a yellow dust. The photoconductivity of such yellow polysilane snow under exposure to white light is very low. Nita et al also report that silane is deposited in mushroom-like form on an inner wall of a reaction tube during reaction of silane. On the other hand, E. J. Spanier and A. G. McDiamid report that when subjected to an ozone type field discharge treatment under reduced pressure of from 143 to 156 mm, silane yields volatile silane (63%), hydrogen gas and solid silicon subhydride ($SiH_{1.2-1.7}$). The hydrogen content of silicon subhydride produced is high, and it ranges, typically, from 54.5 atomic percent to 63 atomic percent.

Since silicon hydride, having a chain structure of $SiH_3$—$(SiH_2)_n$—$SiH_3$, wherein n represents a large integer, has a hydrogen content of 66 to 67 atomic percent, most portions of the silicon subhydride obtained in the above-described ozone type field discharge treatment of silane can be regarded as silicon hydride having a chain structure of the formula —$(SiH_2)_n$— as the main structural component hereof. Such solid silicon hydride as described above is yellow or yellowish brown, and exhibits very low photoconductivity. Furthermore, the aforementioned report of Spanier et al. is concerned with a method for the production of volatile silanes (e.g., having structures of $Si_3H_8$ and so on) and therefore, a further description concerning the solid silicon obtained as a by-product is not found therein.

SUMMARY OF THE INVENTION

In view of the foregoing, it is a general object of the present invention to provide a novel noncrystalline silicon (also referred to as amorphous silicon hereinafter) powder having excellent photoconductivity, photoconductive compositions containing said silicon powder as a photoconductor, and electrophotographic photoreceptors utilizing said photoconductive compositions.

The above-described object can be attained by producing noncrystalline silicon powder through glow discharge decomposition of silane or a derivative thereof, under particular conditions, or through the heating, under particular conditions, of polysilane "snow" obtained from a glow discharge decomposition process.

The noncrystalline silicon powder produced according to the invention comprises silicon and hydrogen, exhibits and infrared spectrum characterized by absorbance peak centered at about 2,000 $cm^{-1}$, wherein the height of said absorbance peak is at least one-tenth the height of the absorbance peak centered at about 630 $cm^{-1}$, and exhibits in the electron spin resonance spectrum thereof a spin density of not more than $10^{18}$ $cm^{-3}$.

Various further and more specific objects, features and advantages of the invention will appear from the description below.

DETAILED DESCRIPTION OF THE INVENTION

Figure 1:
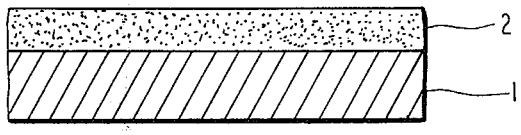
FIG. 1 is a schematic representation of a first illustrative embodiment of this invention, showing the structure of an electrophotographic photoreceptor according to the invention.

First order particles of the noncrystalline silicon fine powder obtained in the present invention are found, from observation using an electron microscope to be very small and to typically have a substantially uniform diameter within the range of from about 0.01 to 1 μm, though such a size range as described above is not critical. However, it is important that the noncrystalline silicon can be obtained in the form of such a fine powder at the time of preparation, because it is practically impossible to grind a thin solid film as described above to a powder having a small size of the same order as that of the above-described first order particles. Therefore, the first object of the present invention is attained with a noncrystalline silicon fine powder comprising at least silicon and hydrogen, which powder is characterized by a peak-height ratio of the absorbance peak centered at about 2000 $cm^{-1}$/the absorbance peak centered at about 630 $cm^{-1}$ in the infrared absorption spectrum thereof, to at least 0.1/1, and by a spin density of not more than $10^{18}$ $cm^{-3}$, as determined by ESR spectroscopy, and by the size of the primary particles ranging from about 0.01 μm to 1 μm.

In accordance with a first embodiment of the present invention, photoconductive compositions are provided which comprise particles of amorphous silicon dispersed into electrically insulating binders.

In a second embodiment of the present invention, electrophotographic photoreceptors are provided which have layers of the above-described photoconductive compositions on supports, at least surface parts of which are electrically conductive.

The photoconductive composition described above is a heterogeneous system, consisting of a discontinuous phase of the amorphous silicon particles and a continuous phase of an electrically insulating binder. Binders of the kind which are electric insulators in the dark and that, possess such an ability that they can transport charge carriers (electrons or positive holes) are used. The electrons or positive holes are generated during the optical excitation of amorphous silicon particles, and are injected to the aforementioned continuous phase, towards the surface of the photoconductive composition or the conductive surface of the support, to permit the charge carriers to discharge at the surface; that is to say, the charge carrier transporting ability, are preferred as the binder for constituting the above-described continuous phase. In order to impart the charge carrier transporting ability to the continuous phase, organic compounds (preferably of low molecular weight) possessing the charge carrier transporting ability; i.e., charge carrier transporting substances, may be dissolved homogeneously in the binders constituting the continuous phase, or charge carrier transporting polymers inherently possessing such charge carrier transporting ability, such as poly-N-vinyl carbazole, which is representative of such polymers, may be employed as the binder constituting the continuous phase.

Accordingly, in a third embodiment of the invention, electrophotographic photoreceptors are provided in which the electrically insulating binders containing charge carrier transporting substances capable of transporting a charge carrier, such as an electron or a positive hole, are employed.

In a fourth embodiment of the invention, electrophotographic photoreceptors are provided in which charge carrier transporting polymers capable of transporting at least one of the charge carriers, viz., an electron or a positive hole, are employed as the binder.

In a fifth embodiment of the invention, electrophotographic photoreceptors are provided in which (a) a light sensitive, charge carrier generating layer (abbreviated as CGL hereinafter), wherein amorphous silicon particles are dispersed in a electrically insulating binder, and (b) a charge carrier transporting layer (abbreviated as CTL hereinafter) are laminated on a support having an electrically conductive surface in such a state that they are maintained in electrical contact with each other. Therein, the term "electrical contact" is used to express a contact state whereby the charge carrier can be transferred from one layer into the other layer. The layer (a) may be laminated on the conductive support directly, or through layer (b). In the former case, for example, the charge carriers generated in the layer (a) by the optical excitation of amorphous silicon particles are driven by the electric field formed between electrostatic charge created on the surface of the laminated by a charging treatment and the conductive support to travel passing through the layer (a) to their respective appropriate surfaces depending upon the polarity thereof; that is to say, to the surface of the conductive support which discharges them or to the interface between the layer (a) and the layer (b). The charge carrier arriving at the interface is transferred into the layer (b), and, transported with layer (b) to reach the surface thereof, where electric neutralization takes place between the charge carrier transported and the electrostatic charge.

The CTL layer (b) is a layer of an electrically insulating binder in which the above-described charge carrier transporting substance is dispersed or dissolved, or a layer consisting of the above-described charge carrier transporting polymer. In addition, with the intention of enhancing the transporting efficiency of the charge carriers in the CGL layer (a), it is feasible to impart the charge carrier transporting ability to the binder constituting the continuous phase in the layer (a) in accordance with the third or fourth embodiment of the invention set forth above.

A technique as described above, in which two functions of an electrophotographic photoreceptor viz, the generation of charge carriers upon exposure to light and the discharging of the charge carriers due to the transportation thereof, are shared separately by two layers adjacent to each other, is already known. As specific examples of the photoreceptors of such a kind, mention may be made of: (1) those which utilize as CGL deposited selenium and as CTL poly-N-vinyl carbazole (*Phys. Rev. B,* Volume 5, page 5 (1972)); (2) those comprising layers of binder polymers into which low molecular weight amines are dispersed (*J. Appl. Phys.,* Volume 49, page 273 (1978)); (3) those which utilize as CGL deposited selenium alloys or photoconductive organic pigment dispersed layers, and, as CTL the layers of binder polymers into which styryl pyrazoline derivatives are dispersed (*Photogr. Sci. Eng.,* Volume 21, page 73 (1977) and U.S. Patent 3,837,851); (4) those which utilize, as CGL, layers into which photoconductive inorganic pigments such as cadmium sulfide and the like are dispersed or the deposited selenium layer and as CTL the polyvinyl pyrene layer or the low molecular weight compound dispersed layers (British Pat. No. 1,337,227); and (5) those which utilize as CGL the dispersion layers of eutectic complexes of pyrylium dyes and polycarbonates and as CTL the layers of binder polymers into which low molecular weight organic photoconductive compounds (such as amines and the like) are dispersed (DAS No. 2,557,430 and published unexamined Japanese Patent Application (OPI) No. 88226/'76) (std OPI def.); and so on.

The term "amorphous silicon particles" used in the present invention describes silicon particles having structures composed of silicon networks not having extended forms of periodic structure as are observed in crystalline silicon. Amorphous silicon is preferable since it has a greater visible ray absorbing capacity than crystalline silicon. Moreover, amorphous particles of which contain at least hydrogen in addition to silicon are employed in the present invention, because amorphous particles containing silicon alone exhibit poor photoconductive characteristics due to the presence of dangling bonds arising from structural imperfections or defects.

In addition to hydrogen, other elements, such as oxygen, fluorine, chlorine, bromine, iodine, phosphorous, arsenic, antimony, boron, aluminum, gallium, and indium, solely or in the form of combination, may be contained in the amorphous silicon particles for the purpose of the control of the electrical conductivity thereof. Thus the amorphous silicon particles in this invention thus refers to a noncrystalline silicon fine powder comprising at least silicon and hydrogen, which is characterized by the peak-height ratio of the absorbance peak centered at about 2000 $cm^{-1}$ over that at about 630 $cm^{-1}$ in the infrared absorption spectrum the value of which ratio is at least 0.1/1, and further by the spin density (g−value=2.004 to 2.006) of not more than $10^{18}$ $cm^{-3}$, and more preferably not more than $5\times10^{17}$ $cm^{-3}$, as determined by ESR measurement. The term "g-valve" is a spectroscopic splitting factor in ESR measurement.

Namely, what configurations are taken in the bonding of the hydrogen atoms to the silicon atoms is particularly important as a factor determining the properties of the noncrystalline silicon powder, such as the apparent color, the optically forbidden transition band width, the photoelectric characteristics, and so forth. In the infrared adsorption spectrum of the fine powder prepared in the present invention within the wavelength region of 2500 $cm^{-1}$ to 600 $cm^{-1}$, bonding configuration modes attributable to $-(SiH_2)_n-$, $=SiH_2$, $\equiv SiH$ and a certain group consisting of silicon and oxygen atoms, respectively, are observed. An important feature observed in the powder of this invention, having a hue of red, brown, black, or the combination thereof; is that the peak-height ratio of the absorbance peak assigned to the $\equiv SiH$ mode (at about 2000 $cm^{-1}$) over the absorbance peak at 630 $cm^{-1}$ (which always appears, even if Si and H are bound to each in any other mode) is greater, compared with the yellow and the yellowish brown powders known in the prior art, and particularly is at least 0.1/1 (that is, at least one-tenth the height of the peak at 630 $cm^{-1}$). In the infrared absorption spectra of powders other than the powders of this invention, absorption peaks arising from the absorption modes attributable to $-(SiH_2)_n-$ and $SiH_2$ are found to be predominent.

Although an unequivocal relation is not held between the hydrogen content and the fraction of $\equiv SiH$ mode in the present invention, there is, in general, a qualitative tendency that decreasing the hydrogen content (50% or less) tends to decrease the possibility of transformation to the $=SiH_2$ bonding configuration and the polysilene type structure of $-(SiH_2)_n-$. Therefore, an improvement in photoelectric properties results. Therefore when the absorbance peak at 2000 $cm^{-1}$ attributable to the absorption spectrum of $\equiv SiH$ mode is at least one-tenth the height relative to the absorbance peak at 630 $cm^{-1}$ attributable to the absorption common to every structure in which hydrogen participates in the bonding to silicon, the effects of the $\equiv SiH$ mode become dominant. Such is the case in the powder of this invention. On the other hand, when the content of hydrogen is too low, compared with that of silicon, the number of the dangling bonds formed by silicon atoms increases and consequently, the ESR spin density also increases, which leads to the aggravation in photoelectric properties. Accordingly, it is also confirmed that powders having an ESR spin density of not more than $10^{18}$ $cm^{-3}$, and more particularly not more than $5\times10^{\int}$ $cm^{-3}$, are desirable.

Furthermore, the photoconductive compositions prepared by dispersing such noncrystalline silicon fine powders as described above into proper binders have been found to have extremely preferable electrophotographic characteristics. First order particles of the noncrystalline silicon fine powder obtained in the present invention are found to be very small and uniform, and can have diameters of from about 0.01 to 1 $\mu$m, according to observations using an electron microscope. Though the size of the fine powder is not critical according to this invention, it is important that the noncrystalline silicon can be obtained in a form of fine powder at the time of preparation, because it is practically impossible to grind a thin solid film to a powder form having a small size of the same order as that of the above-described first order partices.

Accordingly, amorphous silicon particles which can be employed in the present invention can be produced using one of the methods described below:

(a) A method in which silane, a silane derivative or mixture thereof is introduced as a starting material to a vacuum line and thereto, D.C. electric field, A.C. electric field or the combination thereof and optionally, heat up to about 650° C. (preferably from 150° C. to 400° C.), is applied, while partial pressure of the starting material is being controlled so that it may be kept at a certain constant value within the range of 0.01 to 100

Torr, or it may oscillate with a certain amplitude within the same range. Under such a condition as described above, electric discharge of the starting material takes place, to deposit a fine powder having a hue such as red, brown, black or the combination thereof.

(b) a method in which a silicon target is submitted to sputtering or silicon is evaporated in an atmosphere of inert gas containing at least hydrogen to deposit a smoke-like powder.

(c) a method in which the yellow powder most portion of which has a polysilene structure is converted into fine powder having different hue; for example, a hue of red, brown, black or the combination thereof, by receiving a heating treatment under an inert atmosphere or vacuum at a certain temperature within the range of 200° C. to 650° C., preferably from 150° C. to 400° C. for a prescribed period of time (within the range of 1 minute to 10 hours). Means used for the heating treatment include all of those which can, practically, sufficiently raise the temperature of the powder. As specific examples thereof, mention may be made of a heater, an oil bath, an oven, high frequency waves, infrared rays and so on.

(d) A method in which under vacuum cluster ions containing as a main component amorphous silicon or ions of a simple silicon substance are driven by an acceleration electric field and injected, in the form of ion beam, into an electrically insulating binder. The strength of the acceleration electric field is chosen depending on the kind of a binder used, the size and the charge density of cluster ion employed and so on. The upper limit of the strength thereof commonly attainable is 200 KeV. Depth distribution of the ions injected is mainly controlled by the acceleration potential. In order to distribute ions as homogeneously as possible in the insulating binder, acceleration potential may be varied with time as the ions are injected. In such a manner, it becomes feasible to prepare a dispersion of very fine particles in the binder.

Of these preparation methods, the more reliable methods for obtaining noncrystalline silicon fine powders having excellent photoconductivity are the method (a) and the method (c), that is, wherein the glow discharge decomposition of silane or a derivative thereof is utilized or where heat is applied to the decomposition system during or after such glow discharge treatment, respectively. The heating process in these methods consists in acceleration of the release of silicon and hydrogen from the silane gas or the like and/or the noncrystalline silicon fine powder by the thermal energy applied thereto. Heating condition for effecting such an acceleration action cannot be specified, especially in case that an gas under decomposition by means of glow discharge needs to be heated. However, since it is a necessity to render to noncrystalline silicon produced highly photoconductive, heating condition for production of noncrystalline silicon fine powder exhibiting excellent photoconductivity should be experimentally sought in each case and in general the heating temperature is up to about 650° C., preferably from 150° C. to 400° C. The yellow powder composed mainly of polysilene structures can be converted into the highly photoconductive noncrystalline silicon fine powder intended in the present invention by applying heat under such heating condition as described in the method (c).

Specific examples of silanes and silane derivatives which can be used as the starting material for the preparation of amorphous silicon fine powder of the above-described kind include silane, disilane, trisilane, tetrasilane, silicoethylene, silicoacetylene, halogenated silanes, tetrachlorosilane, hexachlorodisilane, octachlorotrisilane, decachlorotetrasilane, dodecachloropentasilane, chlorosilane, dichlorosilane, trichlorosilane, $SiBrCl_3$, $SiBr_2Cl_2$, $SiBr_3Cl$, $SiCl_3SH$, $(SiCl_3)_2O$, $SiClF_3$, $SiCl_2F_2$, $SiCl_3F$, $SiICl_3$, $SiI_2Cl_2$, $SiI_3Cl$, silicon tetrabromide, $Si_2Br_6$, $Si_3Br_8$, $Si_4Br_{10}$, $SiFCl_2Br$, $SiFClBr_2$, $SiF_3Br$, $SiF_2Br_2$, $SiFBr_3$, silicon tetrafluoride, $Si_2F_6$, difluorosilane, trifluorosilane, $SiHCl_2F$, $SiHClF_2$, iodosilane, $SiH_2I_2$, $SiHI_3$, bromosilane, $SiH_2Br_2$, $SiHBr_3$, $Si_2I_6$, disiloxane, silylamine and trichloromethylsilane. These compounds may be used independently, in the form of mixture of two or more of them, or in the form of mixture of one or more of such a compound and other compounds. It is necessary to mix hydrogen therewith when the above-described compound does not contain hydrogen as a constituent elements.

Specific examples of electrically insulating binders employed suitably as the binder for the amorphous silicon particles and as the binder for CTL include inorganic ceramics and rubber, such as water glass, low melting point glass, Sumiceram (trade name, the products of Sumitomo Chemical Co., Ltd.), silicone rubber, etc.; and wide variety of macromolecular compounds and resins having film forming ability, such as silicone resins, polycarbonate, polymethylmethacrylate, polymethylacrylate, polybutylacrylate, polyvinyl chloride, vinyl chloride-vinyl acetate copolymer, vinylidene chloride-vinyl chloride copolymer, vinylidene chloride-acrylonitrile copolymer, polystyrene, poly-α-methylstyrene, polyvinyl butyral, polyvinyl formal, polyvinyl pyrrolidone, polyvinyl alcohol, polyacrylamide, polyacrylonitrile, diacetyl cellulose, triacetyl cellulose, cellulose acetate butyrate, cellulose acetate phthalate, ethyl cellulose, cyanothyl cellulose, polyester, polyamide, styrene-butadiene copolymer, styrene-methylmethacrylate copolymer, styrene-acrylonitrile copolymer, acrylonitrile-butadiene-styrene copolymer, vinylidene chloride-vinyl acetate copolymer, chlorinated polyethylene, chlorinated polypropylene, phenol resin and formaldehyde resin. The ratio of monomer contents in each of the copolymers set forth above is not limited to any special range.

As examples of binders possessing both electrically insulating property and the charge carrier transporting ability (including charge carrier transporting polymers), mention may be made of $V_2O_5$-containing glass semiconductors, poly-N-vinylcarbazole and the derivatives thereof, poly-1-vinylpyrene and the derivatives thereof, charge transfer complexes of these polymers and electron accepting compounds (such as 2,4,7-trinitrofluorenone), and so on.

As for the charge carrier transpoting substances (which are sometimes called "organic photoconductive substances" or "organic electrically active substances" in some patents and literature), various compounds are known, and can be favourably employed in the present invention. Specific examples of such substances include triarylmethanes, triarylalkanes, tetraarylmethanes, diarylalkanes, N,N-dibenzylaniline derivatives, aniline derivatives, distyryl-containing aromatic compounds, polyaryl hydrocarbons, tritolylamine, arylamines, 4-diarylamino substituted chalcones, trinitrofluorenones, pyrazolines, oxadiazoles, thiadiazoles, triazoles, imidazolones, oxazoles, thiazoles, imidazoles, bisimidazolidines, pyrazines, 1,2,4-triazines, arylideneoxazolones, benzothiazole, benzoimidazole, benzoxazoles, quinazolines, benzofurans, acridines, phenazines, carbazoles, ethylene drivatives, benzylideneanilines, polyenes, aminostilbens, arylketones and so on. One or combinations of these compounds can be employed in the present invention.

Specific examples of the support having a surface which is conductive include plates or foils of various kinds of metals; plastic films onto which metals such as aluminum, nickel, chromium, silver, gold, copper, palladium, etc., or semiconductors of compounds such as indium oxide, tin dioxide, etc., are evaporated under vacuum in a form of thin metallic film; plastic films on which layers of dispersions of conductive particles such as cuprous iodide, silver, carbon black, etc. in binder polymers are provided; and so on.

The ratio of the content (by weight) of amorphous silicon to the weight of an electrically insulating binder used in the photoconductive layer or CGL in the present invention is not critical. However, such a ratio should desirably be within the range of about 0.01 to 10, and preferably from 0.1 to 1 in many cases. In addition, the charge carrier transporting substance should desirably be contained in the photoconductive layer or in CTL in a proportion of from about $10^{-4}$ to $1.5\times10^{-3}$ mole, and preferably from $3\times10^{-4}$ to $3\times10^{-3}$ mole, per gram of electrically insulating binder.

A thickness of the photoconductive layer of a monolayer type electrophotographic photoreceptor (corresponding to the embodiment 2, 3 or 4) ranges from about 1 μm to 100 μm, and preferably from 5 μm to 50 μm. The thickness of CGL and the thickness of CTL in an integral unit type electrophotographic photoreceptor (the embodiment 5) are from about 0.1 to 5 μm, and preferably from 0.2 to 2 μm, and about 1 to 100 μm, preferably 5 to 30 μm, respectively. The values of thickness noted above refer to a dried state.

Next, a process for preparing an electrophotographic photoreceptor according to the invention is illustrated below: An electrically insulating binder (or a charge carrier transporting polymer) is dissolved in a proper solvent and optionally, a charge carrier transporting substance is further dissolved therein (in this case, it is necessary to use a common solvent). And thereinto, powdery amorphous silicon is dispersed by means of a homogenizer, an ultrasonic agitator, a magnetic stirrer, a ball mill or the like. Making an additional remark, the addition order may be different from that described above. For instance, after mixing of the binder and the amorphous silicon the resulting mixture may be dissolved in a proper solvent, or after the amorphous silicon is dispersed in a solvent, the binder may be dissolved in the resulting dispersion. In addition, the charge carrier transporting substance may be added at any stage. The thus-obtained solution in which the amorphous silicon is dispersed is coated on a conductive support and dried, resulting in the formation of a photoconductive layer. In case that such a composition as described above is employed as CGL of the integral unit type electrophotographic photoreceptor, it is coated directly on the conductive support, or coated on CTL provided on the conductive support. The CTL is formed by preparing a solution of the charge carrier transporting substance and the electrically insulating binder dissolved in a common solvent therefor or a solution of the charge carrier transporting polymer dissolved in a proper solvent, by coating the resulting solution on the conductive support or on CGL provided on the conductive support and then, by drying it.

As the above-described solvent, any solvent selected from those which can dissolve both the electrically insulating binder used (or the charge carrier transporting polymer used) and the charge carrier transporting substance used and which have relatively high drying rate, may be used. Specific examples of such solvent include alcohols such as ethanol, methanol, isopropanol, etc.; aliphatic ketones such as acetone, methyl ethyl ketone, cyclohexanone, etc.; amides such as N,N-dimethylformamide, N,N-dimethylacetoamide, etc.; dimethyl sulfoxide; ethers such as tetrahydrofuran, dioxane, ethylene glycol monomethyl ether, etc.; esters such as ethyl acetate, methyl acetate, etc.; halogenated hydrocarbons such as chloroform, methylene chloride, dichloroethylene, carbon tetrachloride, trichloroethylene, etc.; hydrocarbons such as benzene, toluene, xylene, ligroin, etc.; water; and so on.

The electrically insulating binder (or the charge carrier transporting polymer) is used in an amount ranging from about 1 g to 50 g, and preferably from 3 g to 20 g, per 100 ml of solvent used. The ratios of the amounts of other additives to the amount of the binder have already been described. Coating can be carried out using a rod coating machine, a roller coating machine, a curtain coating machine, a dip coating machine, a spinner coating machine, a wheeler coating machine and so on. The layers coated are dried at temperatures of from about 20° C. to 200° C., and preferably from 50° C. to 100° C., for periods of from 5 minutes to 5 hours, and preferably 10 minutes to 2 hours.

Moreover, an electrically blocking layer may be provided between the conductive support and the photoconductive layer (or CGL) with the invention of preventing the injection of charge carriers from the conductive support into the photoconductive layer from occurring in the dark. As the blocking layer, the same polymers as employed for the above-described electrically insulating binders can be used. A preferable thickness of the blocking layer is from about 0.1 μm to 1 μm.

EXAMPLE 1

The distance between the cathode and the anode in the parallel plate type sputtering apparatus of Model-SPF-332 (product of Nippon Electric Varian Ltd.) was adjusted to 4.5 cm, and on the cathode (8 cmϕ) was set a glass plate of Number 7059, the products of Corning Glass Works, measuring 10 cm×10 cm×0.8 mm in size. The pressure inside the chamber was reduced to $10^{-6}$ Torr or less by evacuation and then, a silane-argon mixed gas (silane concentration: 21.6%), the products of Japan Oxygen Co., Ltd., was introduced to the chamber. The pathway used for the introduction of the gas was constructed by a pressure controlling valve (the products of Japan Oxygen Co., Ltd., Model 1301 P), a gas flow-meter (the products of Japan Special Gas Co., Ltd., the Ueshima-Brucke's tube R-2-15-D), a stop valve and a ¼ inch stainless steel pipe. The gas flow rate was slackened by placing a metal net and a screen at the outlet for the mixed gas. The pressure inside the chamber was adjusted to 0.28 Torr by regulating the amount of the gas introduced thereto, while the chamber was being evacuated with a rotary pump connected to the exit of the chamber which was provided for permitting the gas to escape. Discharge was carried out by application of high-frequency voltage (13.56 MHz) composed of 40 W of progressive wave and 10 W of reflected wave, the difference of 30 W, to the cathode. After 3 hours' discharge decomposition, red fine powder was obtained both on the glass plate and in the chamber. Yield of the powder on the glass plate was 30 mg.

The first order particles of the red fine powder were found to have a size of about 0.1 micron and to condense to form secondary particles having sizes of 0.5 micron to 1 micron from the observation using a transmission type electron microscope. Further, an X-ray diffraction measurement showed that most portion of the red fine powder exhibited the pattern characteristic of an amorphous structure and a slight portion thereof exhibited weak diffraction peaks attributable to crystalline silicon. Furthermore, infrared absorption spectra of the red fine powder and the yellow powder were measured within the wavelength region of 2500 $cm^{-1}$ to 500 $cm^{-1}$, separately. The most remarkable feature of the red fine powder is that the ratio of the peak height of the absorbance at 2000 $cm^{-1}$, which peak indicates the presence of ≡SiH, over the peak height of the absorbance at 630 $cm^{-1}$, which peak indicates the presence of H, is in the vicinity of 0.5. Namely, the value of such a ratio is much greater in the red fine powder, compared with that of less than 0.1 in the yellow fine powder. Since the absorption peak centered at 2000 $cm^{-1}$ can be assigned to the vibration mode of ≡SiH and the absorption peak centered at 630 $cm^{-1}$ can be observed in all of structures containing hydrogen, the red fine powder has proved to have the structure of ≡Si—H in a large proportion.

The photoconductivity spectrum of the red powder was compared with that of the yellow powder. A nickel-chromium alloy was evaporated at 0.5 mm intervals onto Corning 7059 glass measuring 1.25 cm×2.5 cm×0.8 mm in size using a mask made of stainless steel. Onto the spaces formed between the evaporated areas the red powder was deposited, and 1 KV of electric potential was applied across the space. The red powder under such a condition as described above was irradiated with lights of a halogen lamp (100 V, 120 W) through a NIKON P250 spectrometer in a dark room. Irradiated light was measured by means of a photochopper and a lock-in amplifier (PAR Model-122) according to the alternating current method. Intensity corrections resulting from the passage of light through the spectrometer were made on all wavelengths. Thus, a photoconductivity spectrum was obtained. The spectrum showed a broad band ranging from 360 nm to 750 nm and exhibiting the peak at 515 nm. The photoconductivity of the red powder under white light was greater than that of the yellow powder under white light by a factor of two figures or more. Spin densities of the red powder and a powder obtained by grinding a noncrystalline thin solid film to grains measuring 1.5 μm in diameter were measured by ESR (g-value=2.004 to 2.006). As the results, the spin density of the red powder was $10^{16}$ to $10^{17}$ $cm^{-3}$, while that of the powder obtained by grinding was $10^{18}$ to $10^{19}$ $cm^{-3}$. This indicates that the latter powder has many dangling bonds and therefore, when used as an photoelectric material the latter powder is inferior to the former one because of its very great possibility regarding the loss of carriers which arises from recombination through dangling bonds.

EXAMPLE 2

A powder was prepared in the same manner as in Example 1 except that the pressure inside the chamber was adjusted to 5 Torr. The powder obtained was brownish yellow, and the photoelectric characteristic thereof was very bad. However, when the gas present in the discharge region was irradiated with light generated from a National Movie Light PV-651 (100 V, 650 W), the products of Matsushita Electric Industrial Co., Ltd., through the viewport of the sputtering apparatus from the external side as other conditions were kept unchanged, a red powder (exhibiting good photoelectric characteristics) was produced only during irradiation. In addition, when the gas was heated, instead of irradiation with light, by setting a heater in the chamber, through the heating of the stainless steel pipe used for introduction of the gas, or by using other means, a similar result could be obtained.

EXAMPLE 3

Eighteen kinds of powders were prepared in the same manner as in Example 1 except that four parameters; the partial pressure of the mixed gas, the flow rate of the mixed gas, the high-frequency voltage, whether the mixed gas is heated or not, were changed in various combinations. In the following Table 1, the results of measurements on the color, the optically forbidden transition band width (Eg), the peak-height ratio of the absorbance in the infrared absorption spectrum at 2000 $cm^{-1}$ to that at 630 $cm^{-1}$, and the spin density of each powder were showed. The powder of sample number 5 was yellow and has the peak-height ratio of 0.05 and that, exhibited low photoconductivity. Therefore, this powder is not included in powders obtained in accordance with embodiments of the present invention. Moreover, the powders of sample number 14 and sample number 15 were near black and had spin densities of more than $10^{18}$ $cm^{-3}$ and further, the photoconductivities thereof were low similarly to the powder of sample number 5. Therefore, these powders are also not included in the powders obtained in accordance with embodiments of the present invention.

TABLE 1

| Sample No. | Color | Eg | Peak Height Ratio ($2000cm^{-1}$/ $630cm^{-1}$) | Spin Density |
|---|---|---|---|---|
| 1 | Red | 1.4 eV | 0.46 | $2.33 \times 10^{16}$ $cm^{-3}$ |
| 2 | Red Reddish | 1.42 | 0.49 | $8.8 \times 10^{16}$ |
| 3 | Brown | 1.49 | 0.3 | $1.6 \times 10^{17}$ |
| 4 | Brown Brownish | 1.66 | 0.14 | $1.3 \times 10^{17}$ |
| 5 | Yellow Blackish | 1.91 | 0.055 | $2.42 \times 10^{16}$ |
| 6 | Red Reddish | 1.32 | 0.32 | $3.3 \times 10^{16}$ |
| 7 | Brown | 1.38 | 0.19 | $1.4 \times 10^{17}$ |
| 8 | Brown | 1.7 | 0.13 | $9.5 \times 10^{17}$ |
| 9 | Black Reddish | 1.32 | 0.49 | $4.3 \times 10^{16}$ |
| 10 | Black Reddish | 1.35 | ** | $3.49 \times 10^{17}$ |
| 11 | Black Reddish | 1.38 | 0.33 | $1.7 \times 10^{17}$ |
| 12 | Brown | 1.49 | 0.45 | $1.3 \times 10^{17}$ |
| 13 | Brown | 1.66 | 0.49 | $3.08 \times 10^{17}$ |
| 14 | Black | 1.3 | 0.66 | $1.5 \times 10^{18}$ |
| 15 | Black | 1.32 | 0.5 | $1.7 \times 10^{18}$ |
| 16 | Brown | 1.8 | 0.11 | $8.1 \times 10^{17}$ |
| 17 | Brown Reddish | 1.9 | 0.1 | $1 \times 10^{17}$ |
| 18 | Brown | 1.52 | 0.75 | $2.3 \times 10^{17}$ |

**Not measured

EXAMPLE 4

The yellow fine powder of sample number 5 in Example 3 has proved to be polysilene the main structural component of which is $-(SiH_2)_n-$ from the measurement of infrared absorption spectrum within the range of 2500 $cm^{-1}$ to 600 $cm^{-1}$ because major peaks were observed at 2100 $cm^{-1}$, 890 $cm^{-1}$ and 840 $cm^{-1}$ therein.

This yellow powder was put in a quartz glass tube having an inside diameter of 1 cm, and the tube was evacuated with a vacuum evacuation apparatus till the pressure inside the tube became $10^{-5}$ Torr. Then, it was adjusted to one atmospheric pressure by admitting helium gas. The resulting tube was placed in an electric furnace, and was heated for 10 hours as the temperature of the furnace was kept at 200° C. Thereupon, the powder in the glass tube changed from yellow to brown.

In case that the temperature of the electric furnace was kept at 400° C. for a period of 2 hours under the same condition as described above, the powder in the glass tube changed from yellow to dark brown. In case of heating at 500° C. for a period of 1 hour under the same condition, the powder in the glass tube changed from yellow to dark red, and in case of heating at 650° C. for a period of 1 minute under the same condition, the powder changed from yellow to black.

From the results of X-ray diffraction analyses of each of the above-described thermally processed powders, all of such powders has proved to exhibit patterns characteristic of noncrystalline silicon. In the observations of infrared spectra on these powders, the decrase in the heights of the peaks centered at about 2100 $cm^{-1}$, 890 $cm^{-1}$ and 840 $cm^{-1}$ and the increase in the height of the peak centered at about 2000 $cm^{-1}$ were confirmed.

EXAMPLE 5

The fine powder obtained in Example 1 was dispersed into a binder with the aid of 20 minutes' aggitation using an ultrasonic washer according to the following formula:

| | |
|---|---|
| Amorphous Silicon Fine Powder | 4.5 mg |
| Polycarbonate (Yupiron C-2000, trade name of the products by Mitsubishi Gas Chemical Industries Ltd.) | 90 mg |
| Methylene Chloride | 1 ml |

In the thus obtained photoconductive composition was dissolved 2,4,7-trinitro-9-fluorenone (TNF) as a charge carrier transporting substance in a proportion of $1.6\times10^{-3}$ mole per one gram of polycarbonate. The resulting composition was applied to an aluminium evaporated polyester film (1) (in FIG. 1) (conductive support, "Metalmy", trade name of the products by Toray Industries, Inc.) using a rod coating machine, and dried at 60° C. for 2 hours utilizing a blower. Thus, an electrophotographic photoreceptor having a photoconductive layer (2) (in FIG. 1) 15 μm in thickness was produced.

Next, image was formed on the thus produced electrophotographic photoreceptor according to conventional electrostatic photography. Namely, the conductive support of the electrophotographic photoreceptor was electrically earthed and the photoconductive layer thereof was charged by means of corotron in the dark till surface potential of +400 V to +500 V was created. Then, the surface charged was exposed to light of a tungsten lamp for 5 seconds through a transparent positive original (illuminance at original surface was about 10 lux). Immediately after the optical exposure, cascade development was carried out using negatively charged toner to produce positive image of good quality.

EXAMPLE 6

Figure 2:
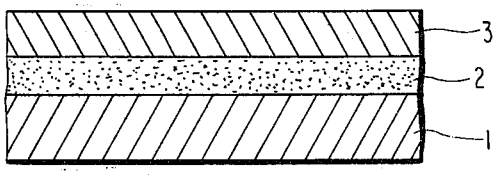
FIG. 2 and FIG. 3 are a second and a third illustrative embodiments of this invention, showing structures, respectively, for an electrophotographic photoreceptor according to the invention. Therein, 1 represents a substrate, 2 represents a photoconductive composition layer, and 3 and 3' represent charge carrier transporting layers.

The photoconductive composition prepared according to the formula described in Example 5 was coated on the same aluminium evaporated polyester film as used in Example 5 by means of a rod coating machine, and dried at 60° C. for 2 hours using a blower to form CGL ((2) in FIG. 2) 2 μm in thickness. Next, 53 mg of 2,4,7-trinitro-9-fluorenone was dissolved as a charge carrier transporting substance in a solution of 90 mg of polycarbonate (the same one as used in Example 5) in 1 ml of chloroform. The resulting solution was coated on the above-described CGL using a rod coating machine, and dried also at 60° C. for 2 hours using a blower to result in the formation of a charge carrier transporting layer (CTL) ((3) in FIG. 3). Thus, an integral unit type electrophotographic photoreceptor as shown in FIG. 2 was obtained. The sum total of the thickness of CGL and that of CTL was 10 μm.

Next, image was formed using this electrophotographic photoreceptor in the same manner as in Example 5. Thus obtained positive image had good quality.

EXAMPLE 7

Fine powders of amorphous silicon particles were prepared in the same manner as in Example 1 except that whether the starting gases were heated or not (at 200°-300° C.), the pressures inside the chamber were different from one another, as described in Table 2, and the RF powers applied were different from one another, as described in Table 2. Each of these fine powders was dispersed into the binder in the same manner as in Example 5 to prepare a photoconductive composition. Further, using each of the thus obtained photoconductive compositions, monolayer type electrophotographic photoreceptors and electrophotographic photoreceptors having double layer construction were produced in the same manners as in Example 5 and in Example 6, respectively. A charging-exposure curve (exposure amount I=4 lux. s) was measured on each of electrophotographic photoreceptors using a charging potential measuring apparatus Model SP 428 (the products by Kawaguchi Electric Co., Ltd.), and optical sensitivity at the starting point of exposure (dE/dt/I) (V. $sec^{-2}$. $\mu m^{-1}$ $lux^{-1}$) was determined on each of electrophotographic photoreceptors. The results obtained are shown in Table 3.

TABLE 2

| Powder Sample | Heating | Pressure | Power | Apparent Color | Eg |
|---|---|---|---|---|---|
| GT 19 | Yes | 1.1 Torr | 30 W | Reddish Brown | 1.47 eV |
| GT 17 | Yes | 0.5 | 30 | Reddish Black | 1.38 |
| GT 21 | No | 5 | 300 | Reddish Brown | 1.38 |
| GT 43 | No | 1.1 | 30 | Red | ** |
| GT 18 | No | 1.1 | 30 | Brown | 1.66 |
| GT 8 | Yes | 5 | 30 | Red | 1.66 |
| GT 20 | Yes | 4 | 300 | Blackish Brown | ** |
| GT 23 | Yes | 10 | 300 | Reddish Black | 1.32 |

TABLE 2-continued

| Powder Sample | Heating | Pressure | Power | Apparent Color | Eg |
|---|---|---|---|---|---|
| GT 42 | No | 0.45 | 30 | ** | ** |

**Not measured

TABLE 3

| Order of Sensitivity | Monolayer Powder Sample | Monolayer Optical sensitivity | Double Layer Powder Sample | Double Layer Optical Sensitivity |
|---|---|---|---|---|
| 1 | GT 19 | E/I = 0.63 | GT 19 | E/I = 0.9 |
| 2 | GT 17 Brown*1 | E/I = 0.18 | GT 17 Brown*1 | E/I = 0.7 |
| 3 | GT 21 | E/I = 0.12 | GT 19b | E/I = 0.6 |
| 4 | GT 8 | E/I = 0.11 | GT 21 | E/I = 0.6 |
| 5 | GT 18 | E/I = 0.1 | GT 43 d = 2.25*5 | E/I = 0.5 |
| 6 | GT 20 Brown*3 | E/I = 0.02 | GT 18 | E/I = 0.43 |
| 7 | GT 23 | E/I = 0.02 | GT 8 | E/I = 0.2 |
| 8 | GT 20 Black*4 | E/I = 0.01 | GT 17 Black*2 | E/I = 0.2 |
| 9 | | | GT 20 Brown*3 | E/I = 0.1 |
| 10 | | | GT 43 d = 3.4*6 | E/I = 0.09 |
| 11 | | | GT 42 | E/I = 0.05 |

*1: Brown powders in Sample GT 17 was used.
*2: Black powders in Sample GT 17 was used.
*3: Brown powders in Sample GT 20 was used.
*4: Black powders in Sample GT 20 was used.
*5 and *6: In preparation of Sample GT 43, the distance between the cathode and anode in the sputtering apparatus was adjusted to 2.25 cm or 3.4 cm, respectively.

EXAMPLE 8

A solution of 4.5 g of polycarbonate (Yupiron C-2000, trade name of the products by Mitsubishi Gas Chemical Industries Ltd., Average molecular weight; 24,000) dissolved in 50 ml of chloroform was coated on a glass plate measuring 100 $cm^2$ in area by means of a rod coating machine, and dried at 60° C. for 2 hours using a blower to provide a polycarbonate layer at a dry coverage of about 0.5$\mu$. Thereon, an amorphous silicon layer about 0.3 $\mu$m in thickness was provided using the red fine powder obtained in Example 1. The silicon layer and the polycarbonate layer were whittled at the same time with a knife out of the laminate constructed by the silicon layer, polycarbonate layer and the glass plate. The thus obtained material was added to a 1 g portion of solution prepared by dissolving 4.5 g of the same polycarbonate as used above in 50 ml of chloroform, and agitated for a period of 5 hours by means of a ultrasonic washer. Thus, a photoconductive composition containing amorphous silicon particles in such a state that they were dispersed homogenously in the chloroform solution of polycarbonate was prepared.

Then, in the thus prepared photoconductive composition was dissolved as a charge carrier transporting substance 35 mg of 1-phenyl-3-(p-methoxystyryl)-5-(p-methoxyphenyl)-pyrazoline. The resulting solution was applied to an aluminium evaporated polyester film (conductive support, Metalmy, the trade name of the products by Toray Industries, Inc.) using a rod coating machine, and dried at 60° C. for 2 hours with a blower. Thus, an electrophotographic photoreceptor having the photoconductive layer 8 $\mu$m in thickness was produced.

Next, image was formed on the thus produced electrophotographic photoreceptor according to conventional electrostatic photography. Namely, the conductive support of the electrophotographic photoreceptor was electrically earthed, and the photoconductive layer thereof was submitted to charging with a corotron in the dark till the surface potential thereof reached −500 V. Then, the charged surface was exposed to light of a tungsten lamp for 5 seconds through a transparent positive original (illuminance at the original surface; about 10 lux). Immediately after the optical exposure, cascade development was carried out using positively charged toner to produce positive image of good quality.

EXAMPLE 9

The photoconductive composition obtained in Example 8 was coated on the same aluminium evaporated polyester film as used in Example 8 using a rod coating machine, and dried at 60° C. for 2 hours using a blower to form CGL having a thickness of 1 $\mu$m. Next, 35 mg of 1-phenyl-3-(p-methoxystyryl)-5-(p-methoxyphenyl)-pyrazoline was dissolved as a charge carrier transporting substance in a 1 g portion of solution of 4.5 g of polycarbonate in 50 ml of chloroform. The resulting solution was coated on the above-described CGL using a rod coating machine, and dried at 60° C. for 2 hours with a blower to produce an integral unit type electrophotographic photoreceptor. The sum total of the thickness of CGL and that of CTL was 10 $\mu$m.

Next, image was formed using the thus produced electrophotographic photoreceptor in the same manner as in Example 8. Positive image of good quality was obtained.

EXAMPLE 10

Figure 3:
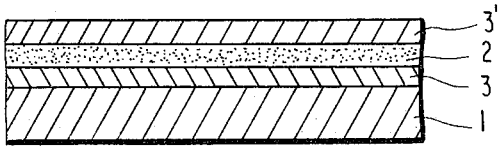

On the aluminium evaporated polyester film, was spread in a layer the same solution of polycarbonate containing 2,4,7-trinitro-9-fluorenone (TNF) as prepared according to the formula described in Example 6 and then, dried to provide an electric charge (electrons in this case) transporting layer ((3) in FIG. 3). Thereafter, a photoconductive composition, which contained 2,4,7-trinitro-9-fluorenone and triarylamine in each concentration of 10% and further, the same amorphous silicon-hydrogen fine powder as obtained in Example 1 dispersed in polycarbonate (weight ratio of the the powder of polycarbonate; 1/20), was provided in a layer on the above-described electron transporting layer, and dried to form the photoconductive layer ((2) in FIG. 3). Further, a solution prepared by dissolving 50 mg of triarylamine, which can act as a positive hole transporting substance, in 1 ml of chloroform containing 90 mg of polycarbonate was coated on the photoconductive layer, and dried to form the other electric charge transporting layer ((3') in FIG. 3). Thus, an integral unit type electrophotographic material was obtained. The total thickness of the photoconductive unit was 15 $\mu$m.

Next, image was formed using the electrophotographic photoreceptor in the same manner as in Example 5. The positive image obtained had good quality.

While the invention has been described in detail and with reference to specific embodiments thereof, it will be apparent to one skilled in the art that various changes and modifications can be made therein without departing from the spirit and scope thereof.

What is claimed is:

1. A process of producing noncrystalline silicon powder comprising silicon and hydrogen, having a primary particle size of from 0.01 $\mu$m to 1 $\mu$m, exhibiting an infrared absorption spectrum characterized by an absorbance peak centered at about 2000 $cm^{-1}$, wherein the height of said absorbance peak is at least one-tenth the height of the absorbance peak centered at about 630 $cm^{-1}$, and exhibiting a spin density of not more than $10^{18}$ $cm^{-3}$ in the electron spin resonance spectrum thereof, the color of said powder being red, brown, black or a combination thereof, said process comprising submitting silane or a derivative thereof to glow discharge decomposition and to further heating before, during or after such decomposition at a temperature up to about 650° C. to directly form said powder without grinding.

2. A process as in claim 1, wherein said silane or derivative thereof is heated before said glow discharge decomposition.

3. A process as in claim 1, wherein said silane or derivative thereof is heated during said discharge decomposition by irradiating the discharge region with light.

4. A process as in claim 1, wherein said silane or derivative thereof is submitted to said glow discharge decomposition and subsequently to heating at a temperature of from 200° C. to 650° C. in an inert atmosphere or under vacuum.

* * * * *